US005403270A

United States Patent [19]

Schipper

[11] Patent Number: 5,403,270

[45] Date of Patent: Apr. 4, 1995

[54] LUMBAR TRACTION APPARATUS AND METHOD OF USE

[76] Inventor: Hirsh L. Schipper, 23 Sunshine Drive, Dollard des Ormeaux, Quebec, Canada

[21] Appl. No.: 109,426

[22] Filed: Aug. 20, 1993

[51] Int. Cl.[6] ..... A61H 1/02

[52] U.S. Cl. ..... 602/36; 606/241

[58] Field of Search ..... 602/32, 34, 36; 606/241; 482/43, 69, 904; 297/274, 275

[56] References Cited

U.S. PATENT DOCUMENTS

| | | | |
|---|---|---|---|
| 1,072,959 | 9/1913 | Kincannon | 297/275 |
| 1,116,773 | 11/1914 | West et al. | 602/36 |
| 1,230,018 | 6/1917 | Patten | 297/275 |
| 4,269,179 | 5/1981 | Burton et al. | 602/36 |
| 4,603,689 | 8/1986 | Horner | 602/32 |
| 5,033,460 | 7/1991 | Goldish | 606/241 |
| 5,277,676 | 1/1994 | Holland et al. | 606/241 |
| 5,288,283 | 2/1994 | Meeker | 297/274 |

FOREIGN PATENT DOCUMENTS

| | | | |
|---|---|---|---|
| 2611135 | 8/1988 | France | 602/36 |
| 124633 | 9/1947 | Sweden . | |

*Primary Examiner*—Richard J. Apley
*Assistant Examiner*—Jeanne M. Clark

[57] ABSTRACT

A lumbar traction device for applying a controlled traction force to particular low back regions of a subject's back by the use of the subject's weight. The device comprises a belt having a predetermined width and length for securement about a subject's abdomino-lumbar region, and impinging upon the lower chest area. An attachment secures the belt about the subject's abdomino-lumbar region. A link chain is connected to each of two antero-lateral connecting points and two postero-lateral connecting points of the belt. Each chain has a connecting frame for securing same to a superior support structure, and an attaching portion for independent adjustable securement to a respective one of the connecting points. The belt and the chains support the subject freely in the air whereby the weight of the subject is caused to apply a traction force to the particular low back region. The method of effecting the controlled traction is also described.

1 Claim, 2 Drawing Sheets

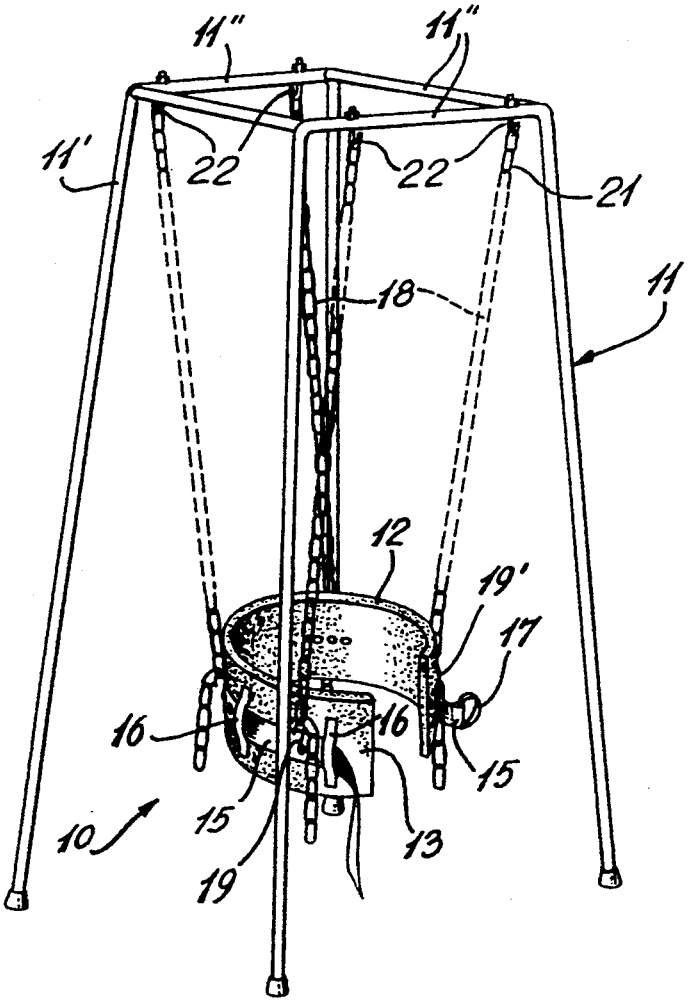
Fig. 1
Fig. 2
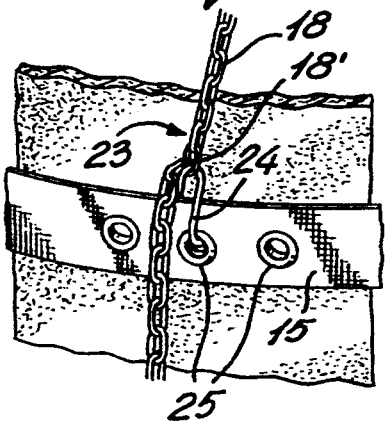
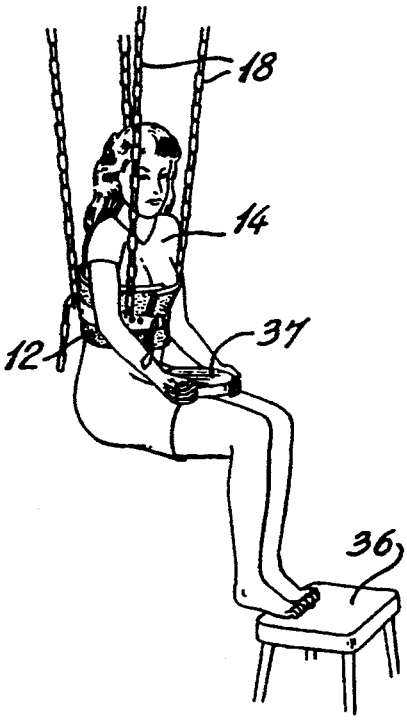
Fig. 3

LUMBAR TRACTION APPARATUS AND METHOD OF USE

TECHNICAL FIELD

The present invention relates to a lumbar traction device and method of use to apply a controlled traction force to the general low back area, as well as to particular low back regions of a subject's back by the use of the subject's weight.

BACKGROUND ART

Low back pain is the second most common reason for visiting a physician in the United States. Most causes of low back pain are of mechanical etiology: low dorsal, dorso-lumbar, lumbar, lumbo-sacral, intervertebral disc compression, herniation, and degenerative disease; low dorsal, dorso-lumbar and lumbar inter-vertebral facet ligamentous strain and arthritis; inter-vertebral and vertebro-iliac ligamentous sprains; low dorsal and lumbar musculo-tendinous strains, as well as low dorsal and lumbar fractures. Low back pain of non-mechanical etiology is not relieved by lumbar traction.

The pathogenesis of mechanical low back pain involves the force of weight of the upper body acting upon the low back during the erect position. Acute or repeated excessive weight bearing is often the precipitating factor. Frequently the main thrust of the weight bearing force is to one side, with the result that low back pain is commonly felt to one side. The usual manner of action of the traumatic force is by a flexion force of the low back, with resultant pathology of compression of the anterior elements of the lower back complex (anterior portions of intervertebral discs, of vertebrae), and of traction of the posterior elements (posterior annulus fibrosus of inter-vertebral discs, intervertebral ligaments, musculo-tendinous junctures).

Lumbar traction has been used since prehistoric times in the treatment of spinal disorders, and is to this day an accepted mode of therapy for mechanical low back pain. This is effected in the horizontal position, usually supine; the traction force being a cord attached to a pelvic belt from the foot of a bed or table, acting against the weight of the upper body. Frequently, the foot of the bed or table is raised to increase the physical moment of the traction force upon the low back. Experimental studies of pelvic traction have demonstrated that traction produces significant widening of the intervertebral space. Epidermal injection of contrast medium was used to outline the posterior aspects of the lumbar discs. This technique has shown that the separation of lumbar vertebrae by traction was significant when disc prolapse was present, and that traction reduced the extent of lumbar disc prolapse. A number of studies have been made to evaluate the clinical benefit of this mode of physiotherapy. It has been found that in patients suffering of low back pain, a group treated with pelvic traction showed significantly greater improvement than a group given conventional treatment, and than a group given no treatment. It has also been found in patients suffering of low back pain and sciatica that lumbar traction nearly always relieved pain while the patient was on treatment. However, the benefit did not last, perhaps because of physical activity between sessions.

SUMMARY OF INVENTION

It is a feature of the present invention to provide a lumbar traction device for applying a controlled traction force to the general low back area of a subject's back by the use of the subject's weight.

Another feature of the present invention is to provide a lumbar traction device which can be used by a subject, wherein the device permits the subject to self-impose a proper controlled traction, as prescribed, by the use of his own weight, and adding additional weights, as necessary.

Another feature of the present invention is to provide a method of applying a controlled traction force to a particular low back region of a subject which allows preferential application of the traction force to particular sites to increase the force of traction, and wherein the method may be used for all causes of mechanical low back pain.

According to the above features, from a broad aspect, the present invention provides a lumbar traction device for applying a controlled traction force to particular low back regions of a subject's back by the use of the subject's weight. The device comprises a belt for securement about a subject's abdomino-lumbar region and impinging upon the lower chest area. Attachment means is provided to secure the belt about the subject's abdomino-lumbar region. Suspension means is connected to each of two antero-lateral connecting points and two postero-lateral connecting points of the belt. Each suspension means has a connecting free end for securing same to a support structure superiorly and an attaching portion for independent adjustable securement to a respective connecting point about the belt. The belt and suspension means support the subject freely in the air whereby the subject's weight provides a traction force the low back region.

According to another broad aspect of the present invention there is provided a method of applying a controlled traction force to a particular low back region of a subject. The method comprises securing a belt about the subject's abdomino-lumbar region. The belt has two antero-lateral connecting points and two postero-lateral connecting points. A suspension means secured to a support structure is connected to each respective one of the connecting points. The suspension means has an attaching portion, and a selected location of the attaching portion is connected to the connecting points. The subject then lifts his feet from the ground to suspend himself by the suspension means with the subject's weight applying a traction force to the particular low back region.

BRIEF DESCRIPTION OF DRAWINGS

A preferred embodiment of the present invention will now be described with reference to the accompanying drawings, in which:

FIG. 1 is a perspective view of the lumbar traction device of the present invention supported by a frame;

FIG. 2 is a perspective view showing an attaching portion of the suspension chain secured to a connecting point of the traction belt;

FIG. 3 is a perspective view showing the manner by which the subject's own weight is used to apply a traction force to selected low back regions of the subject's back;

DESCRIPTION OF PREFERRED EMBODIMENTS

Figure 5:
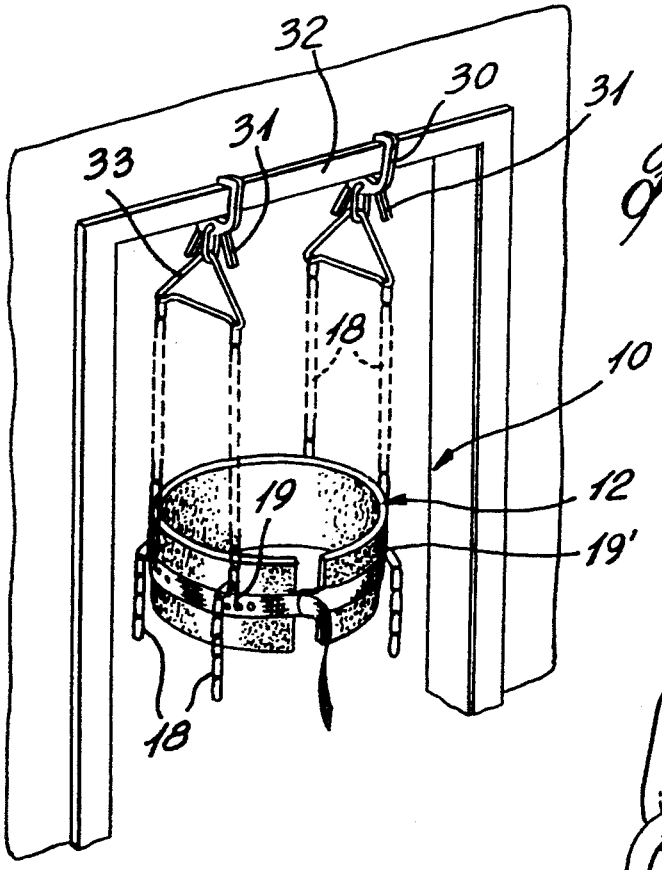
FIG. 5 is a further perspective view showing an alternate manner of suspending the lumbar traction device of the present invention, as herein shown to a door frame.
Figure 4:
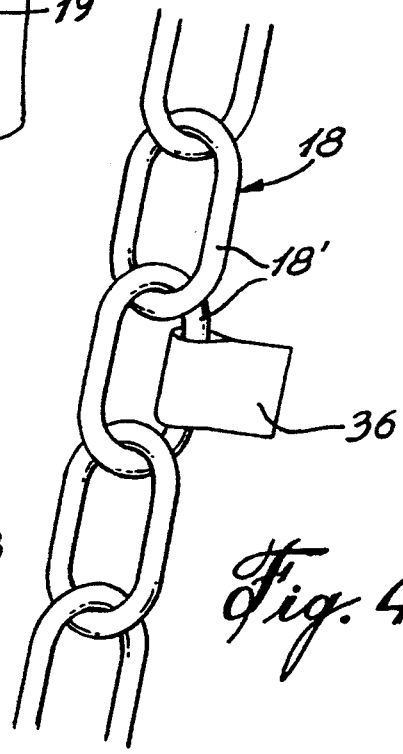
FIG. 4 is a fragmented enlarged view showing the means to identify the chain links to be attached to the hook elements.

Referring now to the drawings, and more particularly to FIG. 1, there is shown generally at 10 a lumbar traction device constructed in accordance with the present invention, and supported by a support structure 11 which is formed by interconnected vertical tubular members 11', and elevated horizontal attaching tubular members 11''. The lumbar traction device 10 comprises a belt 12, herein formed of a large felt pad 13 of predetermined width and length, for securement about a subject's abdomino-lumbar region impinging upon the lower chest area of the subject 14, as shown in FIG. 3. An attachment means in the form of a non-elastic strap 15 encircles the pad 13 and is retained thereto by stitching or fabric loops 16 secured to the pad 13. A buckle 17 is provided at one end of the strap 15 for securing the belt 12 about the thoracic region of the subject.

Referring now additionally to FIGS. 2 to 6, it can be seen that attachment means in the form of link chains 18 are connected to each of two antero-lateral connecting points 19 and 19' and two postero-lateral connecting points 20 and 20'. These are better illustrated in FIG. 6 and are connected to the strap 15. Each of the chains has a connecting free end 21, which consists of the end one of the chain links, for securing same to the support structure 11. As herein shown, the connecting free end link 21 is secured to a hook 22, there being four hooks 22 connected to the attaching tubular members 11' and spaced apart with each hook being connected in alignment and at corners of a rectangle formed by the tubular members and support frame 11.

The link chains 18 are also provided with an attaching portion, which is better illustrated in FIG. 2, and which consists of a lower end section 23 of the link chain 18. This lower end section 23 of each chain 18 is connected to a respective one of four connecting points, herein hook elements 24 secured to the non-elastic strap 15 at a substantially predetermined location. The strap may be provided with reinforced eyelets 25 to permit adjustable securement of the hook element depending on the size of the thoracic region of the subject. On the other hand, the hook element 24 may simply be hooked under the strap 15 at the postero-and antero-lateral connecting points 19, 19' and 20, 20'.

As shown in FIG. 5, the suspension means may be provided by clamps 30 which have a lever 31 to permit attachment and detachment to a horizontal door transom 32. A suspension linkage 33 is secured to each of the clamps 30 with the chains 18 being connected to the linkage. Such clamps 30 and linkage 31 thereby provide a compact and transportable, easy to use suspension means.

Figure 6:
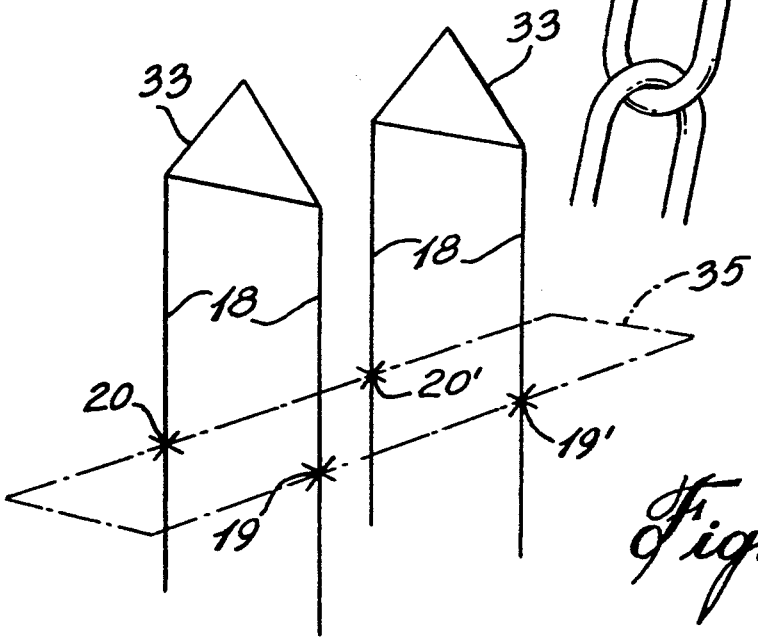
FIG. 6 is a perspective schematic view illustrating the concept of the device for applying a controlled traction force to particular low back regions of a subject's back by connecting suspension link chains to individual connecting points at specific distances with respect to a reference plane.

The lumbar traction device 10 of the present invention was conceived to provide a means for a subject or patient 14 to apply a controlled traction force to a particular low back region by the use of his own weight. Accordingly, in use the patient would attach the belt 12 to the link chains 18 such that the belt is aligned with his thoracic region over his abdomino-lumbar region and when secured impinges upon his lower chest area. The chains 18 are attached to the belt at the two antero- and postero-lateral connecting points 19, 19', 20 and 20'. The subject then places the belt 12 about his abdomino-lumbar region and attaches same tightly thereabout by means of the strap 15. In order for the connecting points 19, 19', 20 and 20' to lie horizontally in a reference plane 35, as shown in FIG. 6, the link chain is provided with identification means, in the form of colored stapled tabs 36 (see FIG. 4), secured to particular ones of the links 18' of the link chain 18. These identification tabs are positioned at a link of each chain to identify the common reference plane 35. With the belt tightly secured about the subject's thoracic region, the subject then lifts his feet off the ground, as shown in FIG. 3, and may steady them on a stool, such as identified by reference numeral 36, to suspend himself off the ground or floor surface. The subject's weight is then suspended by the chains, and this weight applies an upward traction force over the dorso-lumbar region of the subject by means of the attached belt. As shown in FIG. 3, the subject assumes more or less a sitting position. When additional traction weight is necessary, the subject may support a weight, such as a steel disc weight 37, on his lap. Weights from 2 to 20 pounds may be used, as needed.

In the vertical traction mode, as illustrated in FIG. 3, it is possible to apply the traction force preferentially to any of the connecting points 19, 19', 20 and 20' by simply attaching the S-shaped hook elements 24 one or a few links higher in the chain above the reference plane identified by the tabs 36. Further tabs of different color or material may be removably secured to these links to identify the preferential connection of a particular one of the chains 18 depending upon a subject's need.

The effect of this vertical lumbar traction force provides immediate pain relief, and allows cumulative healing. The self-administered treatments may last for a traction period of 2 to 20 minutes. It is pointed out that the lumbar traction device and method of treatment, as above described, is particularly useful for mechanical low back pain and is not to be used for systemic causes and local causes other than mechanical. Also, patients suffering from abdominal or cardio-respiratory pathology are not to be treated by vertical lumbar traction, and this also applies to subjects who cannot assume the erect position.

It can be seen that with the traction apparatus of the present invention a controlled traction force can be applied to a particular low back region of a patient's back. Once the back problem has been diagnosed, the physician can prescribe a treatment that the patient can administer. The treatment may consist in applying a traction force which is increased at one or more of the connecting points by simply connecting the chains at different links above the common reference horizontal plane.

It is within the ambit of the present invention to cover any obvious modifications of the examples of the preferred embodiment described herein, provided such modifications fall within the scope of the appended claims.

I claim:

1. A method for applying a controlled traction force to a particular low back region of a subject, said method comprising the steps of:

(i) securing a belt about the subject's abdomino-lumbar region, said belt having a plurality of antero-lateral connecting points and a plurality of postero-lateral connecting points;

(ii) connecting a suspension means secured to a support structure to a respective selected one of said connecting points;

(iii) selecting a predetermined location for connecting said points to an attaching portion of said suspension means;

(iv) lifting the subject's feet from the ground to suspend himself by said suspension means with the subject's weight applying a traction force to the particular low back region, said step of lifting the subject's feet comprises placing the subject's feet on a stool spaced in front of the subject to provide control of said traction force, there being further provided the step of (v) supporting a weight on the lap of the subject to increase the traction force, and further wherein said step of selecting a predetermined location comprises securing identification means to said attaching portion of each said suspension means to provide a controlled force to the antero-lateral, or the postero-lateral, left or right areas, of the subject's low back region.

* * * * *